US005297916A

United States Patent [19]

Fujikawa et al.

[11] Patent Number: 5,297,916

[45] Date of Patent: * Mar. 29, 1994

[54] CARGO HANDLING VEHICLE HAVING PUSH-PULL UNIT

[75] Inventors: Shinsuke Fujikawa, Funabashi; Haruo Kanauchi; Hiroshi Tsukiyasu, both of Yuuki, all of Japan

[73] Assignee: Komatsu Forklift Kabushiki Kaisha, Japan

[ * ] Notice: The portion of the term of this patent subsequent to Aug. 29, 2008 has been disclaimed.

[21] Appl. No.: 469,256

[22] Filed: Jan. 24, 1990

[30] Foreign Application Priority Data

| | | | |
|---|---|---|---|
| Jan. 26, 1989 | [JP] | Japan | 1-6959[U] |
| May 2, 1989 | [JP] | Japan | 1-5164[U] |
| May 2, 1989 | [JP] | Japan | 1-51645[U] |
| May 12, 1989 | [JP] | Japan | 1-53912[U] |
| May 31, 1989 | [JP] | Japan | 1-62378[U] |
| Jul. 26, 1989 | [JP] | Japan | 1-86822[U] |

[51] Int. Cl.[5] ..... B66F 9/20

[52] U.S. Cl. ..... 414/661; 254/122; 294/103.1; 414/280

[58] Field of Search ..... 414/661, 280, 273, 607, 414/662, 663, 20, 751; 901/38; 254/122, 124; 294/103.1

[56] References Cited

U.S. PATENT DOCUMENTS

| | | | |
|---|---|---|---|
| 1,977,785 | 10/1934 | Wheelock | 414/661 |
| 2,615,682 | 10/1952 | Stone | 294/103.1 X |
| 4,284,384 | 8/1981 | Olson | 414/661 X |
| 4,411,577 | 10/1983 | Shearer, Jr. | 414/273 X |
| 4,742,468 | 5/1988 | Ohashi et al. | 414/273 X |
| 4,861,223 | 8/1989 | Olson | 414/661 |

FOREIGN PATENT DOCUMENTS

| | | | |
|---|---|---|---|
| 281300 | 11/1989 | Japan | 414/661 |

*Primary Examiner*—David A. Bucci
*Attorney, Agent, or Firm*—Ronald P. Kananen

[57] ABSTRACT

A cargo handling vehicle such as a forklift truck having a push-pull unit is improved in responsibility, operation speed and in precise operability by: replacing a conventional hydraulic cylinder for moving a face member 10 back and forth along forks 9 of the vehicle with an electric motor 32. The thus employed motor 32 also eliminates a fear that a cargo 26 is smudged with oil leaking from the hydraulic cylinder and pressurized-oil supply pipes thereof. In cargo loading and discharging operation conducted by the cargo handling vehicle, the face member 10 of the push-pull unit of the vehicle is automatically operated so as to move back and forth along the forks 9 of the vehicle at the substantially same traveling speed as that of the vehicle in a direction counter to a vehicle traveling direction, whereby the sheet pallet B' carrying the cargo 26 is kept substantially stationary during cargo loading and discharging operation or the vehicle.

7 Claims, 10 Drawing Sheets

CARGO HANDLING VEHICLE HAVING PUSH-PULL UNIT

BACKGROUND OF THE INVENTION

1. Field of the Invention

The present invention relates to a cargo handling vehicle having a push-pull unit, and more particularly to a cargo handling vehicle having a push-pull unit which comprises: a face member so mounted on the vehicle as to be movable back and forth along the forks of the vehicle; and a sheet-pallet gripper so mounted on the face member of the vehicle as to be movable in a vertical direction, so that a cargo is loaded onto the forks of the vehicle or discharged from the forks by means of the push-pull unit of the vehicle.

2. Description of the Prior Art

Heretofore, it has been known to provide a cargo handling vehicle such as a high-lift fork truck having a push-pull unit provided with the following construction.

In such conventional cargo handling vehicles: a mast is mounted on a front portion of the vehicle; forks are mounted on the mast as to be movable in a longitudinal direction or vertical direction of the mast; and a face member provided with a sheet-pallet gripper is mounted on the forks as to be movable back and forth therealong.

In the cargo loading operation of the vehicle: the face member of the push-pull unit of the vehicle is moved forward to its forward position along the forks, in which forward position the gripper of the push-pull unit grips a sheet pallet carrying a cargo; after that, the vehicle is moved forward as the face member of the push-pull unit of the vehicle is moved rearward to its rearward position along the forks, to enable the sheet pallet carrying the cargo to be loaded onto the forks, whereby the cargo loading operation of the vehicle is accomplished.

On the other hand, in the cargo discharging operation of the vehicle: under conditions where the sheet pallet carrying the cargo is released mom the gripper of the push-pull unit in the rearward position of the face member on the forks or the vehicle, the vehicle is moved rearward as the face member is moved forward to its forward position along the forks, so that the sheet pallet carrying the cargo is discharged forward from the forks of vehicle to accomplish the cargo discharging operation of the vehicle.

In the conventional cargo handling vehicle having the above construction, a hydraulic cylinder is employed to angularly control a link mechanism through which the forks are moved back and forth. On the other hand, the sheet-pallet gripper for gripping a rear end portion of the sheet pallet is provided in the face member of the vehicle, while constructed of: a sheet-pallet receiving piece fixedly mounted on a lower surface of the face member; and a presser foot vertically driven by a hydraulic cylinder as to be moved toward and away from the sheet-pallet receiving piece.

In the conventional vehicle in which the face member of the push-pull unit is moved back and forth along the forks by the hydraulic cylinder as described above, since pressurized oil is supplied to the hydraulic cylinder to actuate it when a push-pull operation lever of the vehicle is operated by an operator of the vehicle, operation of the vehicle is poor in responsibility and also poor in precise control required to effect a fine control or the face member of the push-pull unit of the vehicle so that the face member is often moved unexpectedly or jerkily.

On the other hand, in case that the presser foot of the sheet-pallet gripper is vertically driven by the hydraulic cylinder, the pressurized oil is supplied to the hydraulic cylinder through long pressurized-oil pipes provided in the vehicle, which pipes and the hydraulic cylinder lie close to the load being handled. As a result, in this case, there is a fear that a pressurized-oil leakage occurs in the hydraulic cylinder and the pressurized-oil pipe will smudge the cargo with the oil.

In the cargo loading operation of the conventional cargo handling vehicle having the push-pull unit: the presser foot of the sheet-pallet gripper of the push-pull unit is moved upward so as to be separated from the sheet-pallet receiving piece of the sheet-pallet gripper, whereby the sheet-pallet gripper is opened; then, the vehicle is moved forward so that a rear end portion of the sheet pallet carrying the cargo is inserted into a space between the presser foot and the sheet-pallet receiving piece or the sheet-pallet gripper; and after that, the presser foot of the sheet-pallet is moved downward to firmly sandwich the rear end portion or the sheet pallet between the presser foot and the sheet-pallet receiving piece or the sheet-pallet gripper. However, since the sheet-pallet gripper is provided in a lower portion of the face member of the push-pull unit of the vehicle, it is very difficult for the operator of the vehicle to watch operation of the sheet-pallet gripper while the cargo loading operation of the vehicle is performed, and, therefore it is very difficult for the operator to confirm whether or not the sheet pallet is firmly gripped by the sheet-pallet gripper.

In addition, in the cargo loading operation of the vehicle: after the rear end portion of the sheet pallet carrying the cargo is firmly gripped by the sheet-pallet gripper of the race member of the push-pull unit, the face member is moved rearward along the forks of the vehicle as the vehicle is moved forward, so that the sheet pallet carrying the cargo is loaded onto the forks of the vehicle whereby the cargo loading operation of the vehicle is accomplished.

In contrast with this, in the cargo discharging operation of the vehicle: the sheet-pallet gripper is opened to release the sheet pallet carrying the cargo from the sheet-pallet gripper of the face member; then, the face member is moved forward along the forks of the vehicle while the vehicle is moved rearward, so that the sheet pallet carrying the cargo is discharged from the vehicle to accomplish the cargo discharging operation of the vehicle. Consequently, in conventional cargo handling operation of the vehicle, first of all, the operator of the vehicle judges whether or not the cargo is loaded onto or discharged from the vehicle. Then, according to the thus judged cargo handling operation, he manually operates the sheet-pallet gripper to grip or release the sheet pallet, and after that he manually operates the face member of the push-pull unit to move the face member forward or rearward while he manually operates the vehicle to move the vehicle rearward or forward. As described above, in the conventional cargo handling operation of the vehicle, the operator of the vehicle must manually control the sheet-pallet gripper in its gripping/releasing operation, the face member in its back/forth movement, and the vehicle in its traveling operation, so that his manual operation required in cargo handling operation of the vehicle is very hard and cumbersome. In addition, in the conventional cargo handling operation of the vehicle, there is a fear that the operator mistakes operations or the sheet-pallet gripper and the face member. For example, in the cargo loading operation of the vehicle, the operator often permits the sheet-pallet gripper to release the sheet pallet therefrom by mistake, and often operates the face member to move forward by mistake. In addition, in the cargo discharging operation of the vehicle, the operator often permits the sheet-pallet gripper to grip the sheet pallet by mistake, and often operates the face member to move rearward by mistake.

It is possible to improve the cargo loading and discharging operation of the vehicle in effectiveness by keeping a traveling distance of the face member equal to that of the vehicle. However, in the conventional cargo handling operation or the vehicle, the operator must carefully operate a face-member control lever or the vehicle while he operates an accelerator pedal or the vehicle to control a traveling speed of the vehicle, so that he keeps a traveling distance of the face member equal to that of the vehicle. Consequently, it is very hard and cumbersome for the operator or the vehicle to keep a traveling distance of the face member equal to that of the vehicle during the cargo loading and discharging operation of the vehicle.

SUMMARY OF THE INVENTION

Under such circumstances, the present invention was made to resolve the above disadvantages inherent in the prior apt. Therefore, it is a first object of the present invention to provide a cargo handling vehicle having a push-pull unit which makes it possible that a face member of the push-pull unit is excellent in its responsibility to smoothly operate in its back/forth movement along the forks of the vehicle.

It is a second object of the present invention to provide a cargo handling vehicle having a push-pull unit which makes it possible that: a sheet-pallet gripper of the push-pull unit automatically performs its gripping-/releasing operation of a sheet pallet; and a face member of the push-pull unit automatically performs its back/-forth movement along forks of the vehicle, whereby an operator of the vehicle is prevented from making mistakes in cargo handling operation while released from hard and cumbersome manual operations of the vehicle during the cargo handling operation.

It is a third object of the present invention to provide a cargo handling vehicle having a push-pull unit which makes it possible: to automatically keep a traveling distance of a face member of the push-pull unit equal to that of the vehicle; and to automatically judge whether or not a sheet pallet carrying a cargo is loaded onto or discharged from the vehicle, so that an operator or the vehicle is prevented from making mistakes in cargo loading and discharging operation of the vehicle to enable him to effectively operate the vehicle during the cargo handling operation of the vehicle.

It is a fourth object of the present invention to provide a cargo handling vehicle having a push-pull unit which makes it possible: to prevent the vehicle from moving unexpectedly in cargo handling operation of the vehicle; and to automatically control the cargo handling operation.

It is a firth object of the present invention to provide a cargo handling vehicle having a push-pull unit which makes it possible: to remove pressurized-oil supply pipes From an area between a face member of the push-pull unit and a vehicle body of the vehicle; and to promptly perform gripping/releasing operation of a sheet pallet carrying a cargo.

It is a sixth object of the present invention to provide a cargo handling vehicle having a push-pull unit which: makes it possible that an operator or the vehicle is not required to watch conditions of a sheet pallet carrying a cargo as to whether or not the sheet pallet is firmly gripped in cargo handling operation of the vehicle; and makes it possible for the operator when he operates a sheet-pallet gripper control lever to easily confirm whether or not the sheet pallet is gripped or released in the cargo handling operation of the vehicle.

According to a first embodiment of the present invention, the above first object of the present invention is accomplished by providing:

In a cargo handling vehicle having a push-pull unit for loading a cargo onto or discharging the cargo from forks of the vehicle, comprising: a mast mounted on a front portion of a vehicle body of the vehicle; a face member so mounted on the mast as to be movable along the mast up and down and movable along forks of the vehicle back and Forth; and a sheet-pallet gripper constructed or a sheet-pallet receiving piece and a presser foot means so mounted on the face member as to be movable up and down relative to the sheet-pallet receiving piece which is fixedly mounted on a lower-end surface of the face member, the improvement wherein: the vehicle further comprises:

an electric motor for driving a link mechanism to perform a back and forth movement of the face member;

a power transmission means connected with the electric motor; and an electric-motor rotational speed control means for controlling a rotational speed of the electric motor according to an external force applied to a push-pull unit control lever for controlling the push-pull unit.

According to a second embodiment of the present invention, the above second object of the present invention is accomplished by providing:

In the cargo handling vehicle having the push-pull unit as set forth in the first embodiment of the present invention, wherein:

the vehicle Further comprises:

a face-member location detecting means for detecting a location or the race member in the back and forth movement thereof; and a controller for judging whether or not the sheet pallet carrying the cargo is loaded onto or discharged from the forks of the vehicle, by using a signal issued from the face-member location detecting means: to issue a gripping signal to the sheet-pallet gripper to cause the gripper to grip the sheet pallet, and to issue a backward movement signal to the electric motor to move the face member backward when the cargo is judged to be loaded onto the forks of the vehicle; and to issue a releasing signal to the sheet-pallet gripper to release the sheet pallet from the gripper, and to issue a forward movement signal to the electric motor to move the face member forward when the cargo is judged to be discharged from the forks or the vehicle.

According to a third embodiment of the present invention, the above third object or the present invention is accomplished by providing:

In the cargo handling vehicle having the push-pull unit as set forth in the second embodiment of the present invention, wherein:

the vehicle further comprises a vehicle-body movement detecting means for detecting a traveling distance of the vehicle body;

the face-member location detecting means comprises a face-member traveling distance detecting means for detecting a traveling distance of the face member; and the controller comprises a current control means for control an amount of an electric current supplied to the electric motor on the basis of a difference between a traveling distance of the face member and that or the vehicle body.

According to a fourth embodiment of the present invention, the above fourth object of the present invention is accomplished by providing:

In the cargo handling vehicle having the push-pull unit as set forth in the first embodiment of the present invention, wherein:

the vehicle further comprises:

an automatic control mechanism for automatically controlling a cargo handling operation of the vehicle;

a gear shifting means for shifting an operational condition of the vehicle to a forward movement condition, a neutral condition and a rearward movement condition;

a vehicle-speed control means for controlling a traveling speed of the vehicle;

a first sensor for issuing a signal when the gear-shirting means is shifted to its neutral position corresponding to the neutral condition of the vehicle;

a second sensor for issuing a signal when the vehicle-speed control means is located in its fully closed position; and a safety means for enabling the automatic control mechanism to operate at a time only when the first and the second sensor issue the signals.

According to a fifth embodiment of the present invention, the above fifth object of the present invention is accomplished by providing:

In the cargo handling vehicle having the push-pull unit as set forth in the first embodiment of the present invention, wherein:

the presser foot means of the sheet-pallet gripper is constructed of: a presser foot; a presser-foot driving electric motor for driving the presser foot up and down relative to the sheet-pallet receiving piece; a feed-screw rod connected to a lower end portion or a power output shaft of the presser-foot driving electric motor to extend downward; and a nut member which is threadably engaged with the feed-screw rod while connected with the presser root through a guide member, the presser foot being disposed under the nut member.

According to a sixth embodiment of the present invention, the above sixth object of the present invention is accomplished by providing:

In the cargo handling vehicle having the push-pull unit as set forth in the fifth embodiment of the present invention, wherein:

the vehicle further comprises:

a control lever for issuing a rotational-speed control signal to the presser-foot driving electric motor; and a sheet-pallet gripper controller for stopping operation of the presser-foot driving electric motor when an amount of an electric current of the presser-foot driving electric motor reaches a predetermined value.

The above objects, additional objects, additional embodiments and advantages of the present invention will be clarified to those skilled in the art hereinbelow with reference to the following description and the accompanying drawings illustrating preferred embodiments of the present invention according to principles of the present invention.

DESCRIPTION OF THE PREFERRED EMBODIMENTS

Hereinbelow, preferred embodiments of a cargo handling vehicle having a push-pull unit of the present invention will be described in detail with reference to the accompanying drawings.

Figure 1:
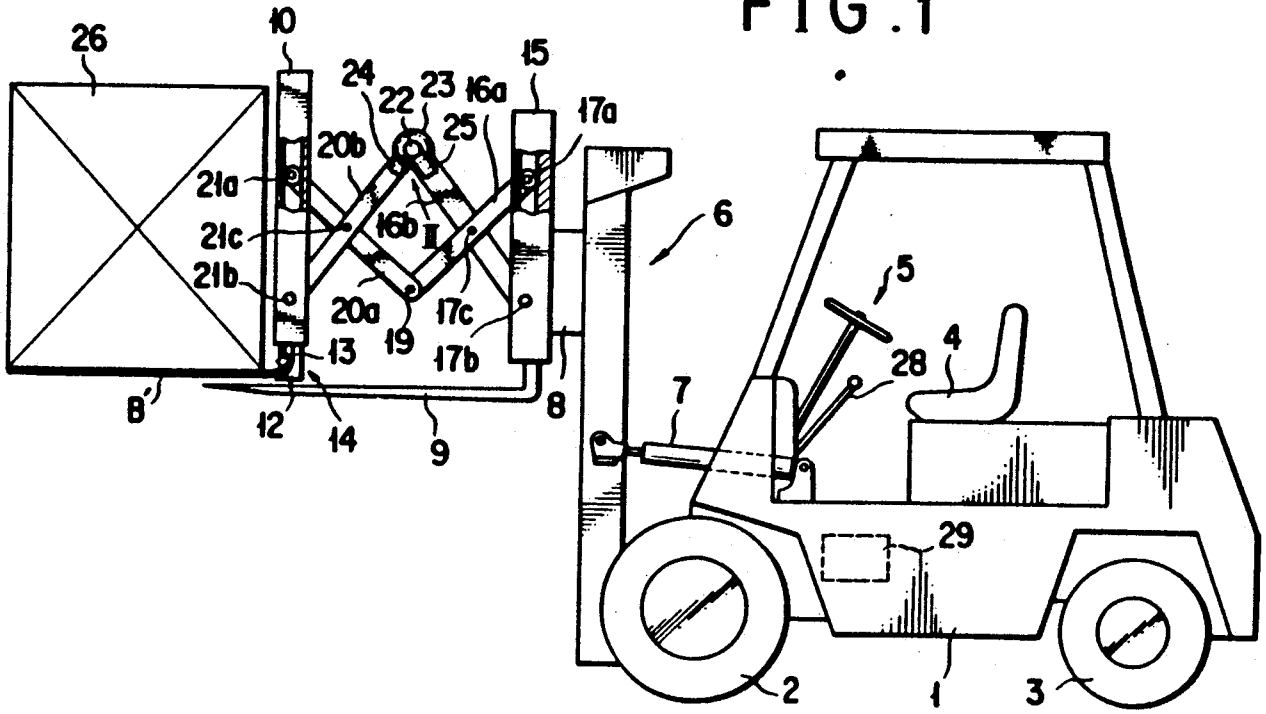
FIG. 1 is a schematic side view of a first embodiment of the cargo handling vehicle of the present invention.
Figure 2:
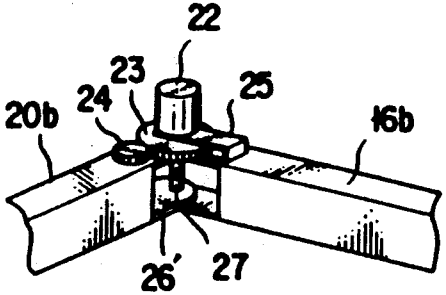
FIG. 2 is an enlarged perspective view of a portion of the first embodiment of the present invention, looking in the direction of arrow 11 shown in FIG. 1.
Figure 3:
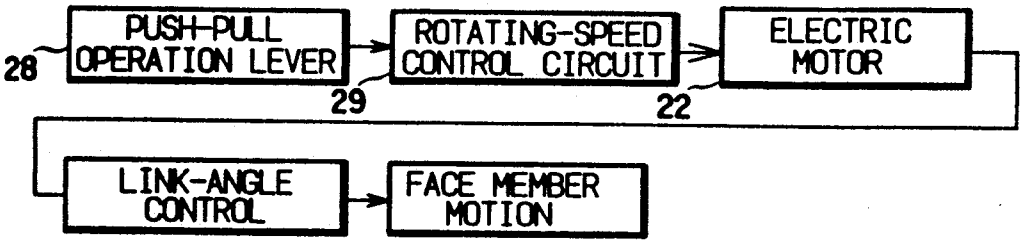
FIG. 3 is a block diagram of the first embodiment of the cargo handling vehicle or the present invention shown in FIG. 1, illustrating operation of the face member of the vehicle.

FIGS. 1 to 3 show a first embodiment of the cargo handling vehicle or the present invention.

As shown in FIG. 1, the cargo handling vehicle is provided with a vehicle body 1 in which are provided: drive wheels 2, steering control wheels 3, an operator seat 4 and a steering member 5. In addition, a mast unit 6 is mounted on a front portion of the vehicle body 1 so as to be tiltable back and forth. A finger board 8 is so mounted on the mast unit or the vehicle as to be slidably movable along the mast unit, on which finger board 8 are mounted at least one fork 9, preferably a pair of forks 9. The push-pull unit is provided with a face member 10 which is so mounted on the finger board 8 as to be movable back and forth along the forks 9 by means of a link mechanism 11. A sheet-pallet gripper 14 is mounted in a lower portion of the face member 10 while constructed of a sheet-pallet receiving piece 12 and a presser root 13. In cargo handling operation of the vehicle, a rear end portion of a sheet pallet B' carrying a cargo 26 is inserted into a space defined between the sheet-pallet receiving piece 1 and the presser foot 13. Under such circumstances, the presser foot is moved downward so that the rear end portion of the sheet pallet B' is firmly sandwiched between the sheet-pallet receiving piece 1 and the presser foot 13, whereby the sheet pallet B' is firmly gripped by the sheet-pallet gripper 14 of the cargo handling vehicle of the present invention.

As shown in FIG. 1, the push-pull unit employed in the first embodiment of the cargo handling vehicle of the present invention is provided with a frame 15 which is moved up and down by the mast unit 6 therealong. The link mechanism 11 is provided with a pair of rear-side links 16*a*, 16*b* and a pair of front-side links 20*a*, 20*b*, and has the following construction in which: rear-end portions of the rear-side links 16*a*, 16*b* are rotatably mounted on the frame 15 through a slide pin 17*a* and a stationary pivot pin 17*b*, respectively, so that the link 16*a* is movable up and down along the frame 15 while rotatably connected with each other at their central portions by means of a pin 17*c*; on the other hand, front-end portions of the rear-side links 16*a*, 16*b* are rotatably connected with rear-end portions of the front-side links 20*a*, 20*b*, respectively; the front-side links 20*a*, 20*b* are rotatably connected with each other at their central portions by means of a pin 21*c*; and front-end portions of the front-side links 20*a*, 20*b* are rotatably mounted on the face member 10 through a slide pin 21*a* and a stationary pivot pin 21*b*, respectively, so that the link 21*a* is movable up and down along the face member 10. The face member 10 of the present invention is provided with the sheet-pallet gripper 14.

In the link mechanism 11 of the push-pull unit of the vehicle of the present invention, the rear-side link 16*a* is rotatably connected with the front-side link 20*a* through a pin 19.

In addition, as is clear from FIG. 2, a bracket 25 is formed in a front-end portion of the rear-side link 16*b*. On the other hand, another bracket 26' is formed in a rear-end portion of the Front-side link 20*b*. These brackets 25 and 26' are rotatably connected with each other through a shaft 27. An electric motor 22 is fixedly mounted on the bracket 25 of the rear-side link 16*b*. A power output shaft of the electric motor 22 is connected to the shaft 27 on which a first gear 23 is fixedly mounted. On the other hand, a second gear 24 is fixedly mounted on a front-end portion of the front-side link 20*b* so as to be meshed with the first gear 23.

The electric motor 22 is controlled through a rotational-speed control circuit 29 by operating a push-pull unit control lever 28, whereby a rotational speed of the motor 22 is so determined as to correspond to an external force applied to the push-pull unit control lever 28.

Now, operation of the first embodiment of the cargo handling vehicle of the present invention will be described with reference to FIG. 3.

A rotational speed of the electric motor 22 is controlled through the rotational-speed control circuit 29 by operating the push-pull unit control lever 28, so that the electric motor 22 is operated. The first gear 23 is rotatably driven by the electric motor 22 thus operated. Then, the first gear 23 rotatably drives the second gear 24 through which the link mechanism 11 is actuated to move the face member back and forth along the forks 9 of the vehicle so that the sheet pallet B' carrying the cargo 26 is loaded onto and discharged from the forks 9 or the vehicle, whereby cargo loading and discharging operation of the vehicle is accomplished.

Consequently, in the cargo loading vehicle having the push-pull unit of the present invention, since the electric motor 22 is operated immediately after the push-pull unit control lever 28 is operated, operation of the vehicle of the present invention is excellent in responsibility and also excellent in precise operability to make it possible that the vehicle is smoothly operated during its cargo handling operation.

Now, a second embodiment or the cargo handling vehicle of the present invention will be described with reference to FIGS. 4 to 6, in which second embodiment, the parts of which are the same as ones employed in the first embodiment of the present invention have been given the same reference numerals, and, therefore are not further explained to avoid redundancy in description.

Figure 4:
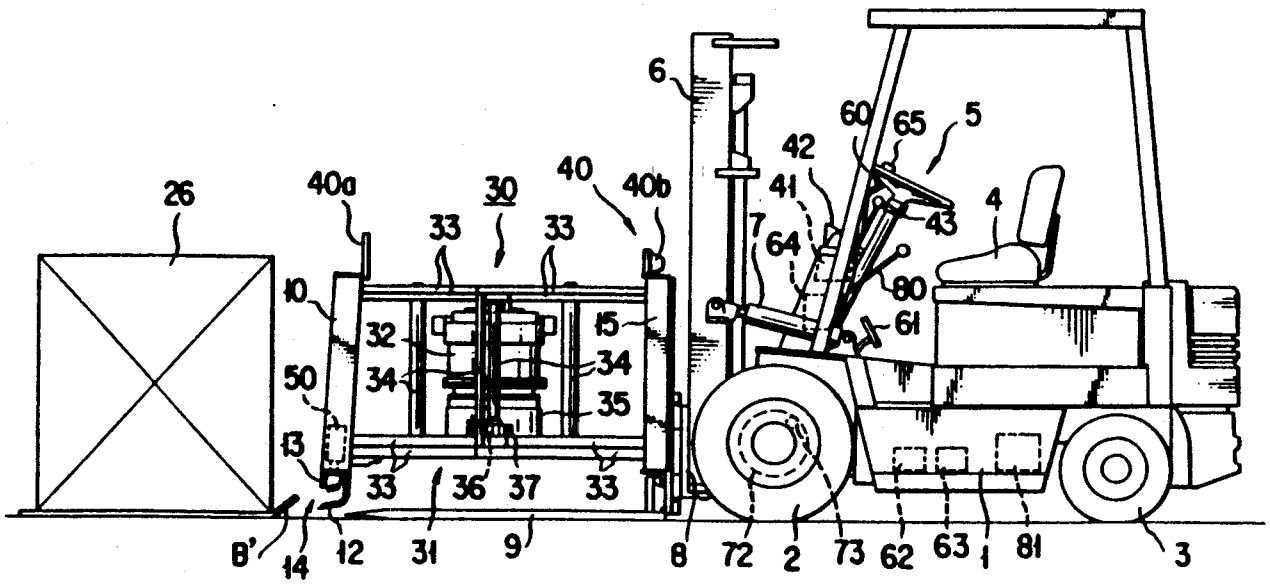
FIG. 4 is a schematic side view of a second embodiment of the cargo handling vehicle of the present invention.

As shown in FIG. 4, in a face-member drive mechanism 30 employed in the push-pull unit of the second embodiment or the cargo handling vehicle of the present invention: an expansion link mechanism 31 is rotatably connected with the frame 15 at its rear-end portion, while rotatably connected with the face member 10 at its front-end portion; and the expansion link mechanism 31 is so actuated by an electric motor 32 as to be expanded and contracted.

More specifically, as shown in FIG. 4, in the face-member drive mechanism 30: a plurality of links 33 are rotatably connected with each other through a plurality of vertical shafts 34 so as to construct the expansion link mechanism 31 which is expandable and contractible; the electric motor 32 is fixedly mounted on the expansion link mechanism 31; a power output-shaft of the electric motor 32 is connected with a first gear 36 through a speed reducer 35; and the first gear 36 is meshed with a second gear 37 fixed to one of the vertical shafts 34, so that the first gear 36 is rotatably driven in its normal direction and in a direction counter to the normal direction when the electric motor 32 is energized, whereby the expansion link mechanism 31 is expanded and contracted to move the face member 10 forth and back.

A face-member location detecting sensor 40 for detecting a distance between the face member 10 and the frame 15 is fixedly mounted on the Frame 15. In operation, the face-member location detecting sensor 40 issues an output ultrasonic wave to a reflecting plate 40*a* fixedly mounted on the face member 10 which reflects the ultrasonic wave on the face-member location detecting sensor 40 as a reflected ultrasonic wave. The thus reflected ultrasonic wave is compared in phase with the output ultrasonic wave to determined a phase difference therebetween. On the basis of the thus determined phase difference, a distance between the face member 10 and the frame 15 is determined by the facemember location detecting sensor 40 serving as an ultrasonic sensor 40b which issues a signal representing the distance between the face member 10 and the Frame 15 to a push-pull unit controller 41 fixedly mounted on the vehicle body 1, whereby the distance between the race member 10 and the frame 15 during a cargo loading operation is automatically controlled through the push-pull unit controller 41.

On the other hand, as shown in FIG. 4, in the vehicle body 1, there is provided: a control panel 42; and a gear-shirting lever 43 for changing a traveling speed and a traveling direction of the vehicle.

Incidentally, the gear-shifting lever 43 may be a conventional speed-change lever of a transmission of the vehicle, or may be a traveling-direction change lever for merely selecting either a forward traveling direction of the vehicle or a rearward traveling direction of the vehicle, or may be replaced with a switch button or a suitable means for changing a traveling speed and a traveling direction or the vehicle.

Figure 5:
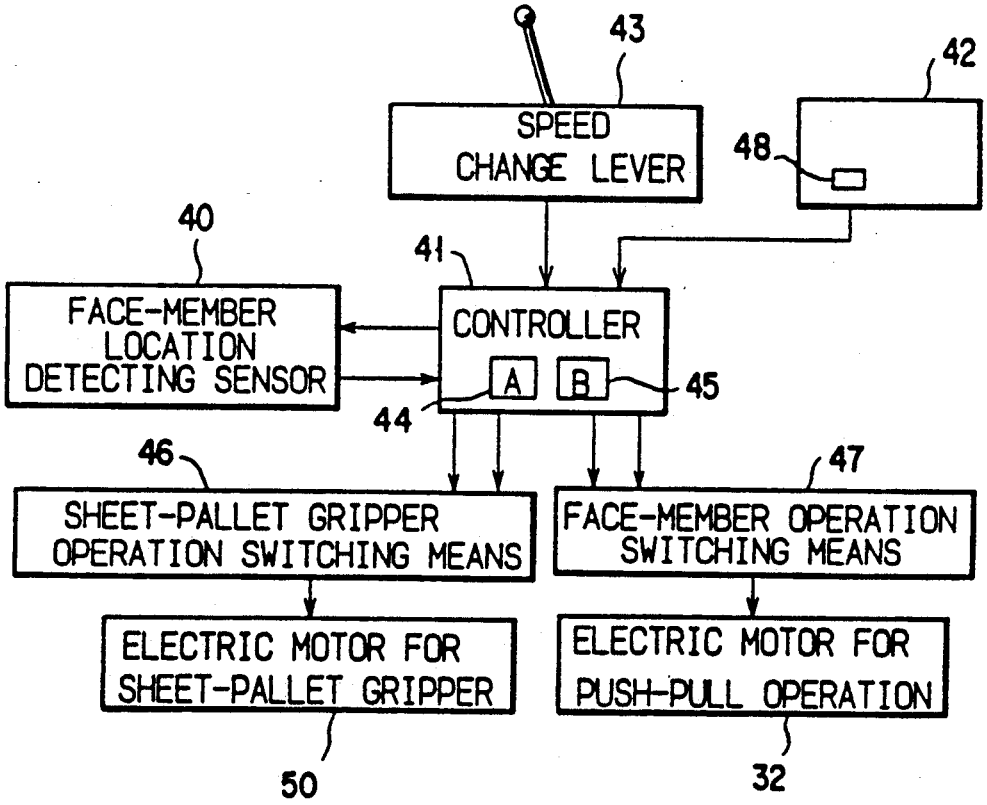
FIG. 5 is a block diagram of a control circuit of the second embodiment of the present invention shown in FIG. 4.

As shown in FIG. 5, the push-pull unit controller 41 is provided with a first setting unit 44 and a second setting unit 45. The first setting unit 44 serves as a memory unit for storing a value of a predetermined distance "A" between the face member 10 and the frame 15 under conditions where the face member 10 is moved forward so as to be separated from the frame 15. On the other hand, the second setting unit 45 serves as a memory unit for storing a value of a predetermined distance "B" between the face member 10 and the frame 15 under conditions where the face member 10 is moved rearward so as to be positioned in the vicinity of the frame 15. Consequently, when a distance between the face member 10 and the frame 15 having been detected by the face-member location detecting sensor 40 is equivalent to the value of the predetermined distance "A" stored in the first setting unit 44, the cargo handling operation conducted by the vehicle is judged as the cargo loading operation or the vehicle. On the other hand, when the distance between the face member 10 and the frame 15 having been detected by the face-member location detecting sensor 40 is equivalent to the value of the predetermined distance "B" stored in the second setting unit 45, the cargo handling operation conducted by the vehicle is judged as the cargo discharging operation of the vehicle.

When the cargo handling operation of the vehicle is judged as the cargo loading operation of the vehicle by means or the push-pull unit controller 41, the controller 41 issues a signal to a sheet-pallet gripper operation switching means 46 such as an electric-current control circuit for controlling an amount of electric current supplied to an electric motor 50, to cause the motor 50 to rotate in its normal direction so that the presser foot 13 is moved downward to firmly sandwich a rear-end portion of the sheet pallet B' carrying the cargo 26 between the presser foot 13 and the sheet-pallet receiving piece 12, whereby the sheet pallet B' is gripped by the sheet-pallet gripper 14. After the sheet pallet B' is gripped by the gripper 14, the controller 41 issues a signal to a face-member operation switching means 47 such as an electric-current control circuit of the electric motor 32 to cause the motor 32 to rotate in a direction counter to a normal rotational direction of the motor 32, so that the expansion link mechanism 31 is contracted to move the face member 10 rearward along the forks 9 of the vehicle, whereby the sheet pallet B' carrying the cargo 26 is loaded onto the forks 9 of the vehicle to accomplish the cargo loading operation of the vehicle.

In contrast with this, when the cargo handling operation of the vehicle is judged as the cargo discharging operation of the vehicle by means of the push-pull unit controller 41, the controller 41 issues a signal to the sheet-pallet gripper operation switching means 46 such as the electric-current control circuit for controlling an amount of electric current supplied to the electric motor 50, to cause the motor 50 to rotate in a direction counter to the normal rotational direction of the motor 50 so that the presser foot 13 is moved upward relative to the sheet-pallet receiving piece 12 so as to release the rear-end portion of the sheet pallet B' carrying the cargo 26 from the sheet-pallet gripper 14. After that, the controller 41 issues a signal to a face-member operation switching means 47 such as the electric-current control circuit of the electric motor 32 to cause the motor 32 to rotate in the normal rotational direction of the motor 32, so that the expansion link mechanism 31 is expanded to move the face member 10 forward along the forks 9 of the vehicle, whereby the sheet pallet B' carrying the cargo 26 is discharged from the forks 9 of the vehicle to accomplish the cargo discharging operation of the vehicle.

Incidentally, in the above control operation of the push-pull unit of the vehicle, the push-pull unit controller 41 issues the above signals to the face-member operation switching means 47 at a time when the push-pull operation lever 43 issues a signal to the controller 41, as shown in FIG. 5.

In the above control operation of the push-pull unit of the vehicle, when a switch 48 provided in the control panel 42 of the vehicle is manually operated by the operator of the vehicle, the switch 48 issues a signal to the push-pull unit controller 41 to cause the controller 41 to issue a signal to the face-member location detecting sensor 40 so that operation of the sensor 40 is started.

Figure 6:
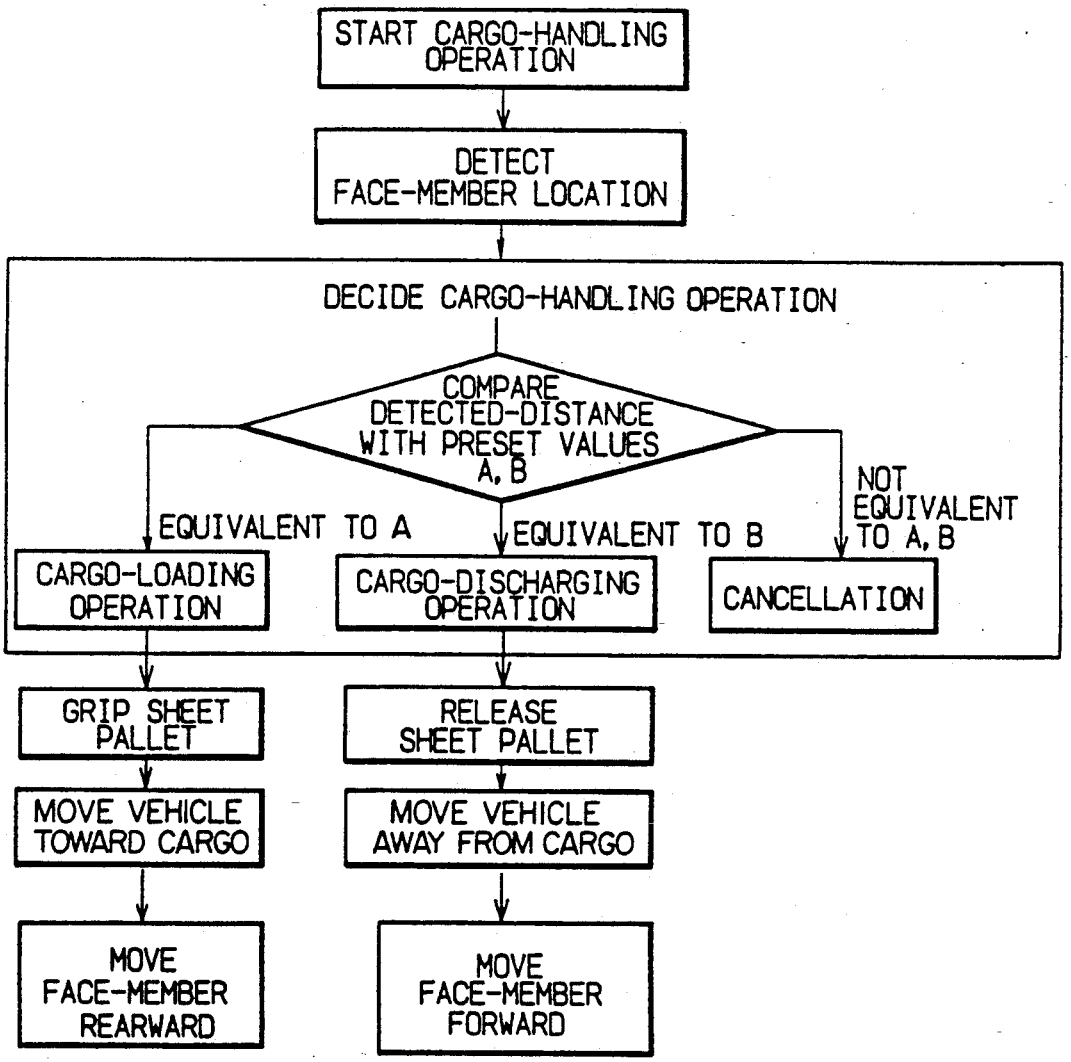
FIG. 6 is a flowchart showing all related processing steps of operation of the second embodiment of the present invention shown in FIG. 4.

The flowchart shown in FIG. 6 shows all related processing steps of the above control operation of the push-pull unit of the vehicle.

Namely, as shown in FIG. 4, in the cargo loading operation of the vehicle, the vehicle is moved forward to approach the sheet pallet B' carrying the cargo 26 so that the rear-end portion of the sheet pallet B' is inserted into a space between the sheet-pallet receiving piece 12 and the presser foot 13 of the sheet-pallet gripper 14 of the push-pull unit or the vehicle. After that, the operator of the vehicle depresses the switch 48 of the control panel 42 of the vehicle so that the switch 48 issues a signal to the push-pull unit controller 41 which in turn issues a signal to the face-member location detecting sensor 40 to actuate the same 40. The thus actuated sensor 40 detects or measures a distance between the frame 15 and the face member 10 and issues a signal representing the thus measured distance to the controller 41. Consequently, when the thus measured distance is equal to the predetermined distance "A" stored in the first setting unit 44, the cargo handling operation conducted by the vehicle is judged as the cargo loading operation of the vehicle by means of the controller 41.

After that, according to the above judgment, the controller 41 issues a signal to the sheet-pallet gripper operation switching means 46 so that the motor 50 is operated to move the presser foot 13 downward, whereby the rear-end portion of the sheet pallet B' carrying the cargo 26 is firmly sandwiched between the presser foot 13 and the sheet-pallet receiving piece 12 of the sheet-pallet gripper 14 or the vehicle.

Under such circumstances, when the push-pull operation lever 43 is shifted to its forward traveling position to cause the vehicle to move forward, the lever 43 issues a signal to the controller 41 which in turn issues a signal to the face-member operation switching means 47 to cause the face member 10 to move rearward along the forks 9 of the vehicle, so that the sheet pallet B' carrying the cargo 26 thereon is loaded onto the forks 9 or the vehicle to automatically accomplish the cargo loading operation or the vehicle.

On the other hand, in the cargo discharging operation of the vehicle, after the vehicle reaches a cargo discharging area, the operator of the vehicle depresses the switch 48 of the control panel 42 of the vehicle so that the switch 48 issues a signal to the controller 41, whereby the controller 41 judges the cargo handling operation of the vehicle as the cargo discharging operation of the vehicle. Consequently, the controller 41 issues a signal to the sheet-pallet gripper operation switching means 46 which in turn issues a signal to the electric motor 50 of the sheet-pallet gripper 14 to rotate the motor 50, whereby the sheet-pallet gripper 14 is opened to release the sheet pallet B' from the gripper 14. Consequently, under such circumstances, when the push-pull operation lever 43 is shifted to its rearward traveling position to cause the vehicle to move rearward, the lever 43 issues a signal to the controller 41 which in turn issues a signal to the face-member operation switching means 47 to cause the face member 10 to move forward, whereby the cargo discharging operation of the vehicle is automatically accomplished.

In the cargo loading and discharging operation of the vehicle described above, it is preferable that the traveling speed of the vehicle in its forward and rearward movement is equivalent to the moving speed of the race member 10 relative to the frame 15.

For example, after the traveling speed of the vehicle and the moving speed of the face member are measured respectively, when there is a difference between the traveling speed of the vehicle and the moving speed of the face member 10, the moving speed of the face member 10 is so controlled as to be equivalent to the traveling speed of the vehicle.

Incidentally, the face-member location detecting sensor 40 may be constructed or: a plurality of mechanical limit switches for detecting the limits of expanding and contracting movements of the expansion link mechanism 31 of the push-pull unit of the vehicle; or a counter means for counting a rate of rotation of the electric motor 32, which means issues a signal representing the rate of rotation op the motor 32 to the controller 41 in which the signal is compared with a predetermined value to determine a location of the face member 10; or a means for measuring an expanded and a contracted length of a telescopic hydraulic cylinder in case that the expansion link mechanism 31 is replaced with such telescopic hydraulic cylinder which moves the face member 10 back and forth along the forks 9 of the vehicle.

Now, a modification of the second embodiment of the cargo handling vehicle of the present invention will be described with reference to FIGS. 7 and 8, in which modification, the parts of which are the same as ones employed in the second embodiment of the present invention have been given the same reference numerals as shown in FIG. 4, and therefore are not further explained to avoid redundancy in description.

Figure 7:
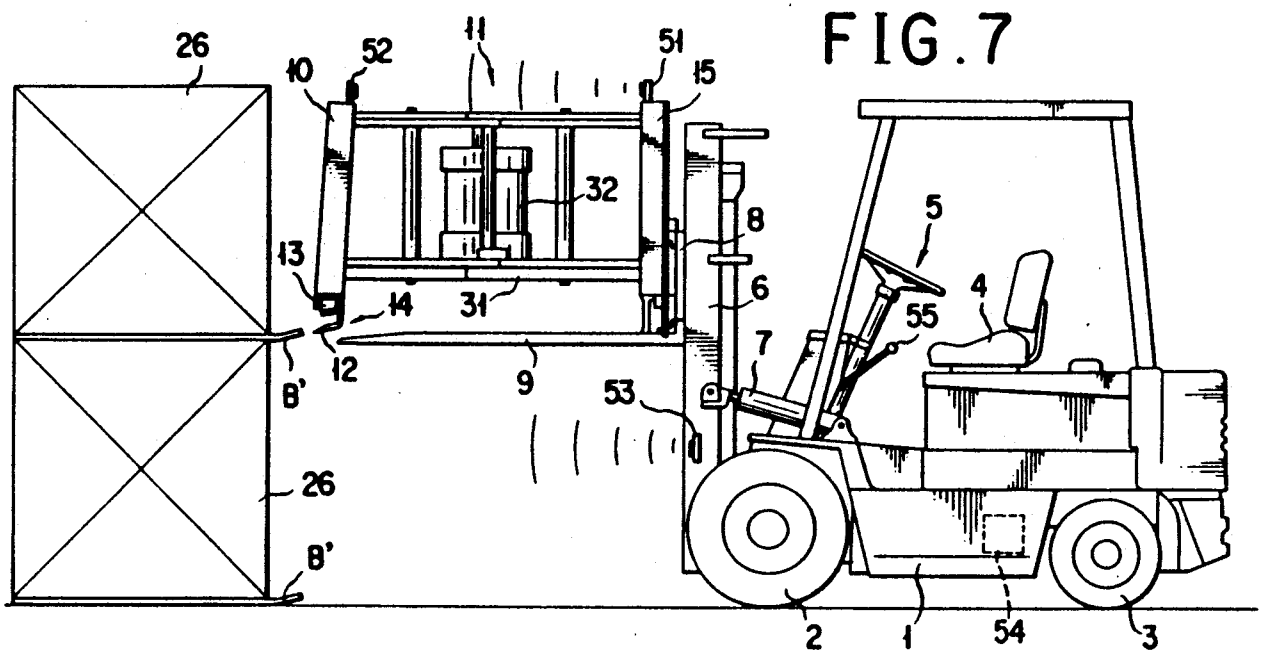
FIG. 7 is a schematic side view of a modification of the second embodiment of the present invention shown in FIG. 4.

In the modification shown in FIG. 7, the link mechanism 11 is provided with a means for measuring a traveling distance of the face member 10 relative to the frame 15, which means is constructed of: for example, an ultrasonic sensor 51 fixedly mounted on the frame 15; and a reflecting plate 52 fixedly mounted on the face member 10. In measuring operation of the traveling distance of the face member 10, the ultrasonic sensor 51 issues an output ultrasonic wave from an ultrasonic generator portion of the sensor 51 to the reflecting plate 52 which reflects the ultrasonic wave. As a result, the thus reflected ultrasonic wave From the reflecting plate 52 is detected by an ultrasonic receiving portion of the ultrasonic sensor 51 in which a phase difference between the output ultrasonic wave and the reflected ultrasonic wave is measured, and, on the basis of the thus measured phase difference, a distance between the face member 10 and the frame 15 is calculated to determine a traveling distance of the face member 10 relative to the frame 15.

As shown in FIG. 7, a means for measuring a traveling distance of the vehicle body 1 relative to the cargo 26, for example such as an ultrasonic sensor 53 is fixedly mounted on the mast unit 6 or the cargo handling vehicle. An ultrasonic generator portion of the ultrasonic sensor 53 issues an output ultrasonic wave to the cargo 26 which reflects the ultrasonic wave. As a result, the thus reflected ultrasonic wave from the cargo 26 is detected by an ultrasonic receiving portion of the ultrasonic sensor 53 in which a phase difference between the output ultrasonic wave and the reflected ultrasonic wave is measured, and, on the basis of the thus measured phase difference, a distance between the mast unit 6 of the vehicle and the cargo 26 is calculated to determine a traveling distance or the vehicle body 1 relative to the cargo 26.

Figure 8:
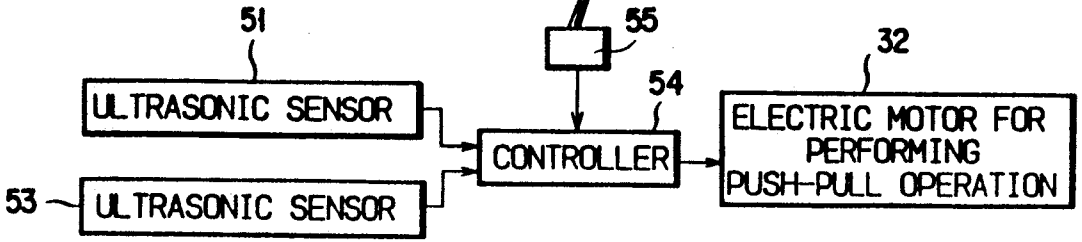
FIG. 8 is a block diagram of a control circuit of the modification shown in FIG. 7.

As shown in FIG. 8, signals representing both of the traveling distance of the face member 10 measured by the ultrasonic sensor 51 and that of the vehicle measured by the ultrasonic sensor 53 are issued from these sensors 51, 53 to a push-pull unit controller 54 in which a difference between the traveling distance of the face member 10 and that of the vehicle is determined, and, on the basis of the thus determined difference in traveling distance, an amount of electric current supplied to the electric motor 32 for driving the link mechanism 11 is determined.

In the modification shown in FIGS. 7 and 8, when the operator of the vehicle operates a push-pull operation lever 55, the lever 55 issues a signal to the controller 54 which in turn issues a signal to the motor 32 to cause the motor 32 to rotate in its normal direction or in a direction counter to the normal direction. Under such circumstances, an amount of the electric current supplied to the motor 32 depends on a difference between the traveling distance of the face member 10 and that or the vehicle.

For example, when the traveling distance of the face member 10 is larger that that of the vehicle, an amount of the electric current supplied to the motor 32 is reduced to lower the rotational speed of the motor 32, so that a traveling speed or the face member 10 is decreased. On the other hand, when the traveling distance of the face member 10 is smaller that that of the vehicle, an amount of the electric current supplied to the motor 32 is increased to increase the rotational speed of the motor 32, so that a traveling speed of the face member 10 is increased.

As a result, in the modification shown in FIGS. 7 and 8, it is possible to automatically control the traveling distance of the race member 10 so as to be equivalent to that of the vehicle.

The above means for measuring the traveling distance of the face member 10 relative to the Frame 15 may have a construction in which: a rotary encoder (not shown) is provided in a rotating portion of the electric motor 32 to measure a rate or rotation of the motor 32, and, on the basis of the thus measured rate of rotation, a traveling distance of the face member 10 is calculated; or a rotary encoder (not shown) is provided in a rotary shaft employed in the link mechanism 11 to measure a rate of rotation of the rotary shaft, and, on the basis of the thus measured rate of rotation, a traveling distance of the face member 10 is calculated.

Now, a third embodiment or the cargo handling vehicle of the present invention will be described with reference to FIG. 4. The vehicle body 1 is provided with a gear-shifting lever 60 for selecting a traveling speed and a traveling direction of the vehicle. The gearshifting lever 60 may be a traveling-direction switching lever for shifting the traveling direction of the vehicle to a forward traveling direction or a rearward traveling direction. The vehicle body 1 is also provided with a vehicle-speed control member 61 such as an accelerator pedal. In the vehicle of the third embodiment of the present invention, when the gear-shifting lever 60 is shifted to a forward-traveling position, a neutral position and a rearward-traveling position, there are selected in a transmission of the vehicle a forward-speed gear, a neutral gear and a rearward-speed gear, respectively. On the other hand, in operation of the vehicle, as the vehicle-speed control member 61 such as the accelerator pedal is operated or depressed, a rate or rotation of an engine of the vehicle increases, to make it possible to control the traveling speed of the vehicle by means of such vehicle-speed control member 61.

As shown in FIG. 4, the third embodiment of the vehicle of the present invention is provided with: a neutral-gear position detecting sensor 62 for detecting a condition in which the transmission of the vehicle is in neutral; a low-speed detecting sensor 63 for detecting a condition in which the engine speed of the engine of the vehicle is low; an automatic control mechanism 64; and an automatic operation starting switch 65. The neutral-gear position detecting sensor 62 detects that the gear-shirting lever 60 of the vehicle is positioned in a neutral position thereof; or that a transmission controller of the vehicle is in a neutral condition thereof; or that a transmission of the vehicle is in a neutral condition thereof. On the other hand, the low-speed detecting sensor 63 detects a condition in which the vehicle-speed control member 61 is released from an external force applied thereto by the operator or the vehicle; or a condition in which an engine controller keeps the operation of the engine of the vehicle at a low speed; or a condition in which a rotational speed of the engine of the vehicle is kept at a low level.

Figure 9:
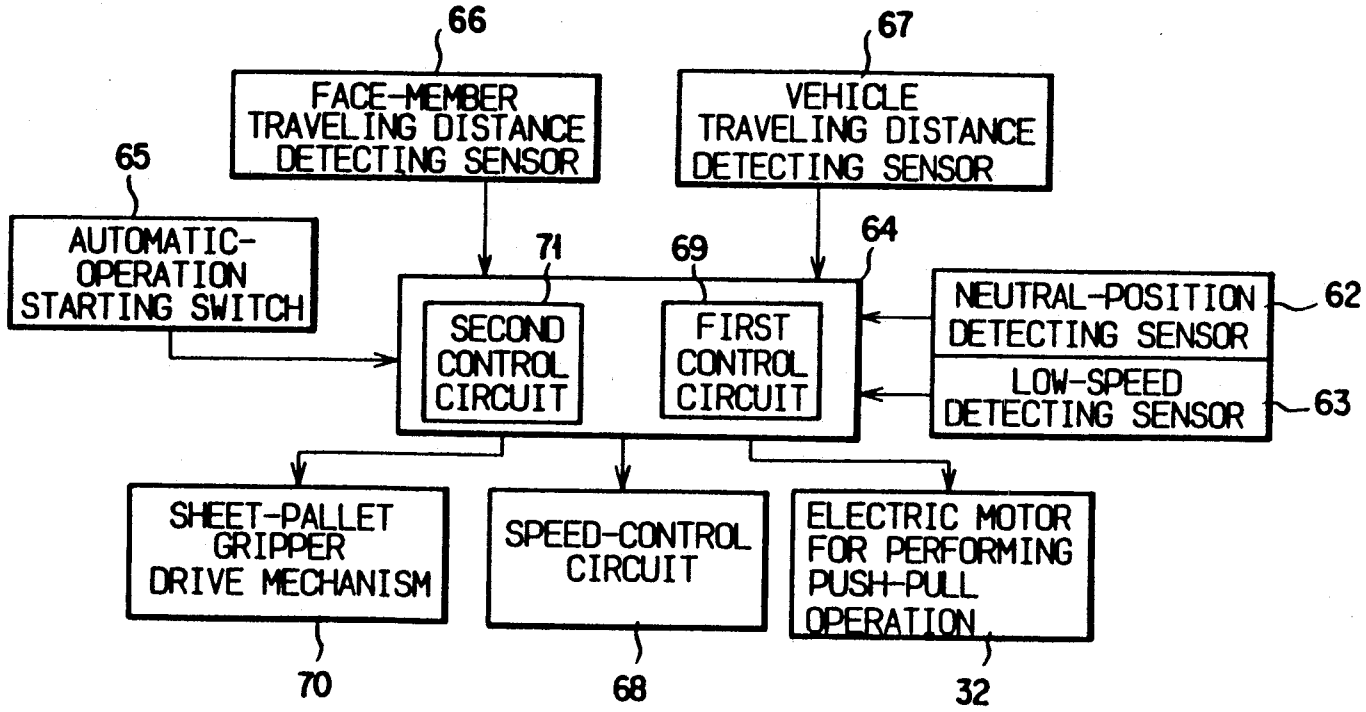
FIG. 9 is a block diagram of a control circuit of a third embodiment of the cargo handling vehicle of the present invention.

As shown in FIG. 9, the automatic control mechanism 64 described above is provided with: a first control circuit 69 for issuing a control signal to the above speed-control circuit 68 of the motor 32 on the basis or the signals representing the traveling distance of the face member 10 and that of the vehicle issued from the race-member traveling distance detecting sensor 66 and the vehicle traveling distance detecting sensor 67 respectively; and a second control circuit 71 for issuing a starting signal to the above speed-control circuit 68 and a sheet-pallet gripper drive mechanism 70. After a signal has been issued from the automatic-operation starting switch 65 to the automatic control mechanism 64, when a neutral signal and a low-speed signal issued from the neutral-gear position detecting sensor 62 and the low-speed detecting sensor 63 respectively are received by the automatic control mechanism 64, both of the first control circuit 69 and the second control circuit 71 are actuated to operate the automatic control mechanism 64.

The sheet-pallet gripper drive mechanism 70 is provided with: a hydraulic cylinder, a movable part of which is connected with the presser foot 13, the hydraulic cylinder being provided in the face member 10; or an electric motor 50 for rotatably driving a screw rod relative to a nut fixed to the presser foot 13 to move the foot 13 up and down relative to the motor 50, the motor 50 being fixed to the face member 10. In addition, a face-member forward location signal and a face-member rearward location signal are issued to the first control circuit 69 and the second control circuit 71 or the automatic control mechanism 64, respectively. When the face-member forward location signal received by the first control circuit 69 of the automatic control mechanism 64, the automatic control mechanism 64 issues a facemember rearward traveling signal to the speed-control circuit 68, and also issues a sheet-pallet gripping signal to the sheet-pallet gripper drive mechanism 70 to move the presser foot 13 downward, i.e., to grip the sheet pallet B' carrying the cargo 26 by means of the sheet-pallet gripper 14 of the vehicle. After the gripper 14 grips the sheet pallet B', the automatic control mechanism 64 permits the face member 10 to move rearward relative to the Frame 15 along the forks 9 of the vehicle. On the other hand, when the face-member rearward location signal received by the second control circuit 71 of the automatic control mechanism 64, the automatic control mechanism 64 issues a race-member forward traveling signal to the speed-control circuit 68, and also issues a sheet-pallet releasing signal to the sheet-pallet gripper drive mechanism 70 to move the presser foot 13 upward, i.e., to release the sheet pallet B' carrying the cargo 26 from the sheet-pallet gripper 14 of the vehicle. After the gripper 14 releases the sheet pallet B' therefrom, the automatic control mechanism 64 permits the face member 10 to move forward relative to the frame 15 along the forks 9 of the vehicle.

As a means for issuing both of the face-member forward location signal and the face-member rearward location signal, it is possible to employ: a circuit for judging whether the face member 10 locates in its forward location or in its rearward location on the basis of the traveling distance of the face member 10 measured by the face-member traveling distance detecting sensor 66; or a circuit for judging whether the face member 10 locates in its forward location or in its rearward location on the basis of the total number of rotations of the electric motor 32 in its normal rotational direction or in a direction counter to the normal rotational direction of the motor 32, the total number or rotations of the motor 32 being counted from a reference position of the motor 32; or any other suitable means for mechanically judging whether the face member 10 locates in its forward location or in its rearward location by detecting the degree of expansion or the degree of contraction of the expansion link mechanism 31.

The face-member traveling distance detecting sensor 66 is constructed of: for example as shown in FIG. 4, the ultrasonic sensor 40*b* fixedly mounted on the frame 15 of the vehicle; and the reflecting plate 40*a* fixedly mounted on the face member 10. As already described above, a traveling distance or the race member relative to the frame 15 is calculated on the basis of the phase difference between: the output ultrasonic wave issued from the ultrasonic sensor 40*b* to the reflecting plate 40*a*; and the reflected ultrasonic wave From the reflecting plate 40*a*, which wave is received by the ultrasonic sensor 40*b*.

On the other hand, the vehicle traveling distance detecting sensor 67 is provided with: for example as shown in FIG. 4, a rotary disk 72 fixedly mounted on a rotating side of the drive wheel 2 of the vehicle; and a photo sensor 73 fixedly mounted on a stationary side of the drive wheel 2. Consequently, in the vehicle traveling distance detecting sensor 67, the number of rotations of the rotary disk 72 is detected by the photo sensor 73. As a result, it is possible to calculate a traveling distance of the vehicle on the basis of the thus detected number of rotations of the rotary disk 72 and an outer diameter of the drive wheel 2.

Figure 10:
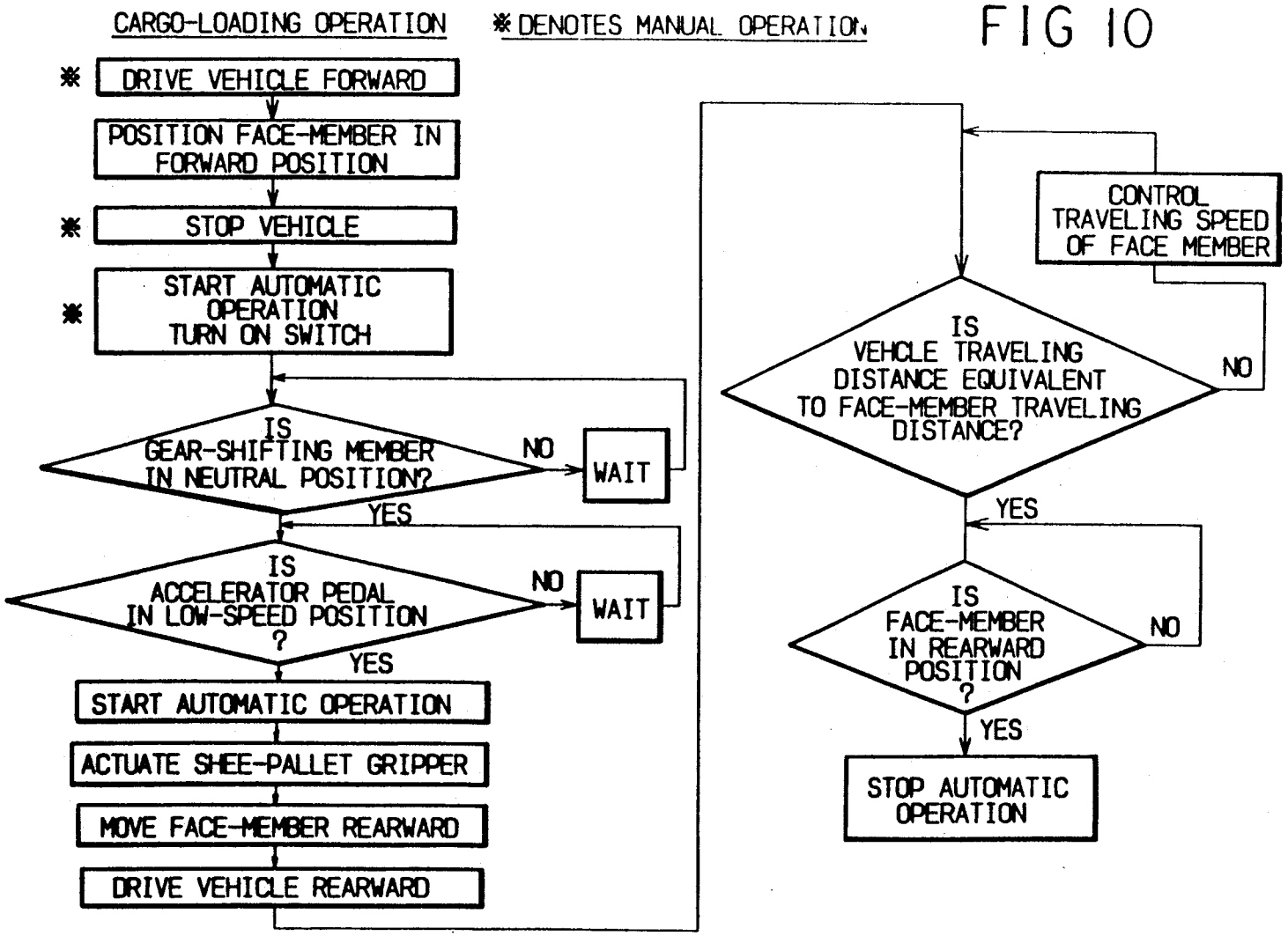
FIG. 10 is a flowchart showing all related processing steps of operation of the third embodiment of the present invention shown in FIG. 9.

Now, operation of the third embodiment of the cargo handling vehicle of the present invention will be described with reference to the flowchart shown in FIG. 10.

In cargo handling operation of the third embodiment of the vehicle of the present invention: the face member 10 locates in its forward location; the gear-shifting lever 60 is positioned in its forward-speed position; and the vehicle-speed control member 61 such as the accelerator pedal of the vehicle is positioned in its high-speed position or depressed, so that the vehicle moves forward. After the sheet-pallet gripper 14 of the vehicle reaches a cargo loading operation starting position in which the gripper 14 receives the rear-end portion of the sheet pallet B′ carrying the cargo 26, the forward traveling motion of the vehicle is stopped by depressing a brake pedal of the vehicle so that the vehicle body 1 is kept stationary. Under such circumstances, the operator of the vehicle depresses or turns on the automatic operation starting switch 65 of the vehicle to permit the switch 65 to issue a signal to the automatic control mechanism 64, whereby the automatic control mechanism 64 starts in operation.

Then, the operator of the vehicle shifts the gear-shifting lever 60 to its neutral position, and moves the vehicle-speed control member 61 to its low-speed position to permit the neutral-position detecting sensor 62 and the low-speed detecting sensor 63 to issue the neutral signal and the low-speed signal respectively to the automatic control mechanism 64. Under such circumstances, since the race-member forward location signal is already received by the second control circuit 71 or the automatic control mechanism 64, the sheet-pallet gripping signal is issued from the second control circuit 71 of the automatic control mechanism 64 to to the sheet-pallet gripper drive mechanism 70 which in turn causes the presser foot 13 or the sheet-pallet gripper 14 to move downward, i.e., to grip the rear-end portion of the sheet pallet B′ carrying the cargo 26. At the same time, the first control circuit 69 of the automatic control mechanism 64 issues the face-member rearward traveling signal to the electric motor 32 to actuate the motor 32 so that the motor 32 drives the link mechanism 11, whereby the face member 10 moves rearward relative to the frame 15 along the forks 9 of the vehicle to accomplish the cargo loading operation or the vehicle.

On the other hand, in the cargo discharging operation of the vehicle, the operator of the vehicle shifts the gear-shirting lever 60 to the reverse-speed position of the transmission of the vehicle, and operates the vehicle-speed control member 61 such as the accelerator pedal of the vehicle so as to be positioned in its high-speed position or so as to be depressed. As a result, the vehicle moves rearward at a relatively high speed. At this time, the traveling distance of the face member 10 relative to the frame 15 is kept equivalent to that of the vehicle body 1 of the vehicle by controlling the rotational speed of the electric motor 32 so that the cargo discharging operation of the vehicle is accomplished.

In the cargo handling operation or the vehicle, when the automatic-operation starting switch 65 is not turned on or depressed, if the gear-shifting lever 60 is not shifted to its neutral position and the vehicle-speed control member 61 is not shifted to its low-speed position, the automatic control operation of the vehicle does not start. Consequently, under such circumstances, it is possible to prevent the operator of the vehicle from making mistakes in cargo handling operations, which ensures that the operator shifts the gear-shifting lever 60 to the neutral position thereof and shifts the vehicle-speed control member 61 such as the accelerator pedal of the vehicle to the low-speed position thereof, whereby it is always ensured that: at the beginning of the automatic control operation conducted in the cargo handling operation of the vehicle, the transmission of the vehicle is kept in neutral condition while the engine is operated at a low engine-speed. Consequently, for example, in the cargo discharging operation of the vehicle, the operator properly operates the gear-shifting lever 60 and the vehicle-speed control member 61 without fail to properly move the vehicle rearward. As a result, there is no fear that the vehicle moves forward or moves unexpectedly at the beginning of the automatic control operation conducted in the cargo discharging operation of the vehicle.

Warning lamps may be provided in the vehicle to enable the operator of the vehicle to conform the steps of the automatic control operation conducted in the cargo handling operation of the vehicle.

Namely, in case that the automatic control operation of the vehicle starts when the signal issued from the automatic-operation starting switch 65 is received by the automatic control mechanism 64, there is a problem: that the vehicle hits the cargo 26 under conditions where the gear-shirting lever 60 has been shifted to the forward-speed position thereof by the operator of the vehicle; or that the vehicle moves unexpectedly under conditions where the vehicle-speed control member 31 has been shifted to the high-speed position thereof by the operator. However, as already described above, it is possible for the vehicle of the present invention to eliminate the above problem by employing the neutral signal and the low-speed signal which are issued from the neutral-position detecting sensor 62 and the low-speed detecting sensor 63 respectively, and enable the automatic control operation conducted in the cargo handling operation of the vehicle to start.

As described above, after completion of the cargo loading operation or the vehicle in which the sheet pallet B′ carrying the cargo 26 thereon is loaded onto the forks 9 of the vehicle, the face-member traveling distance detecting sensor 66 issues a signal representing the rearward location of the face member 10 to the automatic control mechanism 64 to stop the automatic control operation conducted in the cargo loading operation of the vehicle.

The cargo discharging operation of the vehicle is conducted in a similar way to that of the cargo loading operation of the vehicle described above.

Incidentally, in the above embodiments of the present invention, it is described that the vehicle is driven by the engine through the transmission. However, it is also possible that the vehicle is driven by an electric motor. In case that the electric motor drives the vehicle, a direction of electric current supplied to the electric motor for driving the vehicle is controlled by a suitable direction-change lever such as the gear-shifting lever 60, an amount of which electric current is controlled by a suitable current-control means such as the vehicle-speed control member 61. The electric current is at zero when the above current-control means is shifted to its neutral position, whereby the electric motor for driving the vehicle stops in operation.

In addition, the vehicle driven by the electric motor as described above may be provided with a suitable face-member traveling control member and a suitable sheet-pallet gripper control member, in which vehicle the face member 10 may be manually moved back and forth along the forks 9 of the vehicle and the sheet-pallet gripper 14 may be also manually operated.

Now, a fourth embodiment of the cargo handling vehicle of the present invention will be described with reference to FIG. 4.

As shown in FIG. 4, in the fourth embodiment of the vehicle of the present invention, the vehicle body 1 of the vehicle is provided with: a sheet-pallet gripper controller 81 for controlling the sheet-pallet gripper 14 of the push-pull unit of the vehicle; and a sheet-pallet gripper control lever 80 for operating the sheet-pallet gripper 14.

Figure 11:
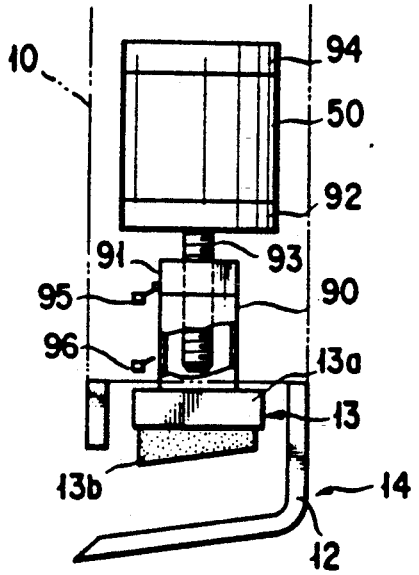
FIG. 11 is a side view of a sheet-pallet gripper employed in the push-pull unit of the cargo handling vehicle or the present invention.

As shown in FIG. 11, the presser foot 13 of the sheet-pallet gripper 14 is provided with a body 13*a* in a lower surface of which a pad member 13*b* is fixedly mounted. On the other hand, in an upper surface of the body 13*a* of the presser foot 13 is fixedly mounted a sleeve-like guide member 90 in an upper portion of which is fixedly mounted a nut member 91 such as ball nuts. The guide member 90 of the presser foot 13 is so mounted in the face member 10 as to be slidably movable up and down relative to the face member 10 and as to not rotatable relative to the face member 10.

The electric motor 50 is fixedly mounted in the face member 10 to actuate the sheet-pallet gripper 14. The power output shaft of the motor 50 is connected with a feed-screw rod 93 and like male screws or worm members through a speed reducer 92. The screw rod 93 is threadably engaged with the nut member 91 such as ball nuts described above. The electric motor 50 is provided with a brake mechanism 94 for lowering a rotational speed of the motor 50 and for keeping the motor 50 stationary.

Figure 12:
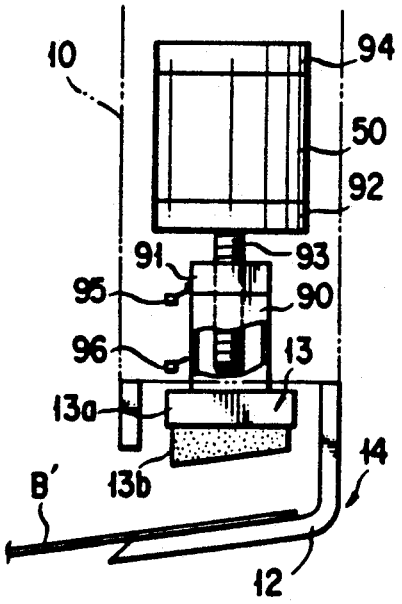
FIG. 12 is a side view of the sheet-pallet gripper of the vehicle of the present invention when the gripper is opened.
Figure 13:
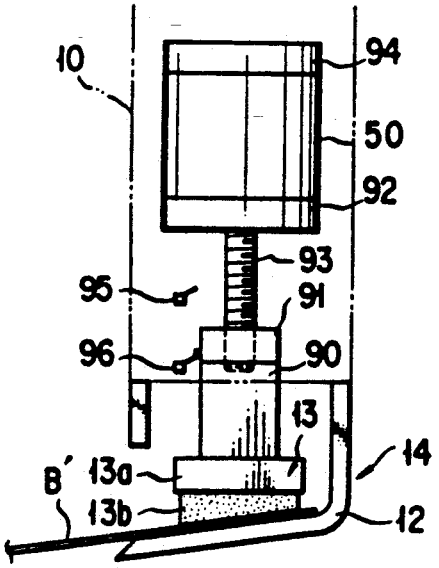
FIG. 13 is a side view of the sheet-pallet gripper of the vehicle or the present invention when the gripper is closed to grip a rear end portion of the sheet pallet carrying the cargo.

Under conditions where the rear-end portion of the sheet pallet B' carrying the cargo 26 thereon is inserted into a space defined between the sheet-pallet receiving piece 12 and the presser foot 13 as shown in FIG. 12 in the beginning of the cargo loading operation of the vehicle, when the electric motor 50 rotates in its normal rotational direction to rotatably drive the feed-screw rod 93, the presser foot 13 is moved downward. As a result, as shown in FIG. 13, the rear-end portion of the sheet pallet B' is firmly sandwiched between the presser foot 13 and the sheet-pallet receiving piece 12 or gripped by the sheet-pallet gripper 14 or the push-pull unit of the vehicle.

On the other hand, in the beginning of the cargo discharging operation or the vehicle, when the electric motor 50 rotates in a direction counter to the normal rotational direction of the motor 50 to rotatably drive the feed-screw rod 93, the presser foot 13 is moved upward. As a result, the rear-end portion of the sheet pallet B' carrying the cargo 26 is released from the sheet-pallet gripper 14 as shown in FIG. 12.

Now, a control circuit of the electric motor 50 will be described with reference to FIG. 14.

Figure 14:
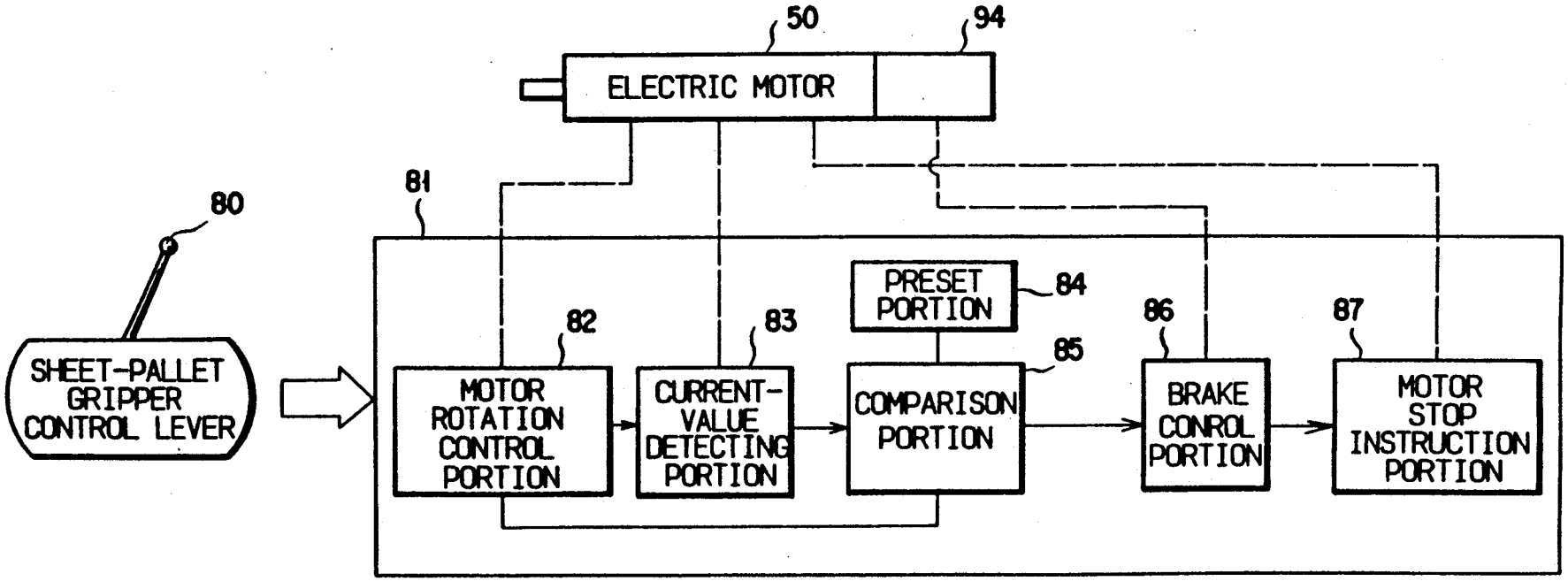
FIG. 14 is a block diagram of a control circuit of an electric motor for driving the sheet-pallet gripper of the cargo handling vehicle of the present invention.

As already described above, the vehicle body 1 is provided with the sheet-pallet gripper controller 81 and the sheet-pallet gripper control lever 80 as shown in FIGS. 4 and 14.

As shown in FIG. 14, the sheet-pallet gripper controller 81 is provided with: a motor rotation control portion 82; a current-value detecting portion 83; a preset portion 84; a comparison portion 85; a brake control portion 86; and a motor stop instruction portion 87.

As shown in FIG. 4 and already described above, in the cargo loading operation of the vehicle, the vehicle moves forward to approach the sheet pallet B' carrying the cargo 26. After that, the face member 10 is moved forward to its forward location along the forks 9 of the vehicle so that the rear-end portion of the sheet pallet B' is inserted into a space defined between the presser foot 13 and the sheet-pallet receiving piece 12. Under such circumstances, when the operator of the vehicle operates the sheet-pallet gripper control lever 80, the normal-rotation signal is issued to the motor rotation control portion 82 of the sheet-pallet gripper controller 81 so that the electric motor 50 rotates in its normal rotational direction, whereby the presser root 13 is moved downward as already described above to make it possible to grip the rear-end portion of the sheet pallet B' by means or the sheet-pallet gripper 14. However, under such circumstances, the electric motor 50 keeps on rotating after the sheet-pallet gripper 14 grips the sheet pallet B' as described above. As a result, the thus increased load on the electric motor 50 permits an amount of electric current passing through the motor 50 to increase.

The amount of the electric current passing through the motor 50 is detected by the current-value detecting portion 83 of the sheet-pallet gripper controller 81 to permit the current-value detecting portion 83 to issue a signal to the comparison portion 85 of the same controller 81 so that the thus detected amount of the electric current or the motor 50 is compared with a predetermined value stored in the preset portion 84 as to whether or not they are equivalent to each other. In case that they are equivalent to each other, the brake control portion 86 of the controller 81 issues a brake signal to the brake mechanism 94 to actuate the same 94 so that the electric motor 50 is locked to the brake mechanism 94. At the same time, the motor stop instruction portion 87 of the sheet-pallet gripper controller 81 issues a signal to the electric motor 50 to cut off the electric current supplied to the motor 50.

As a result, the electric motor 50 remains locked to the brake mechanism 94 to permit the presser foot 13 of the sheet-pallet gripper 14 to apply a predetermined gripping pressure to the rear-end portion of the sheet pallet B', which predetermined gripping pressure corresponds to the amount of the electric current having been supplied to the motor 50.

As shown in FIGS. 11 to 13, stroke-end position detecting means for detecting an upper and a lower stroke-end position of the presser foot 13, for example such as a first limit switch 95 and a second limit switch 96 are fixedly mounted in the race member 10 so as to be turned on and off by means of the nut member 91 which is fixedly mounted on the presser foot 13. The stroke-end position detecting means such as the limit switches 95, 96 may be replaced with any other means for detecting the upper and the lower stroke-end position of the presser foot 13, in which other means for counting the number of rotations of the electric motor 50 in its normal rotational direction and in a direction counter to such normal rotational direction is detected by a rotary encoder (not shown) so that the upper and the lower stroke-end position or the presser foot 13 are calculated on the basis of the thus detected number of rotations of the motor 50.

Figure 15:
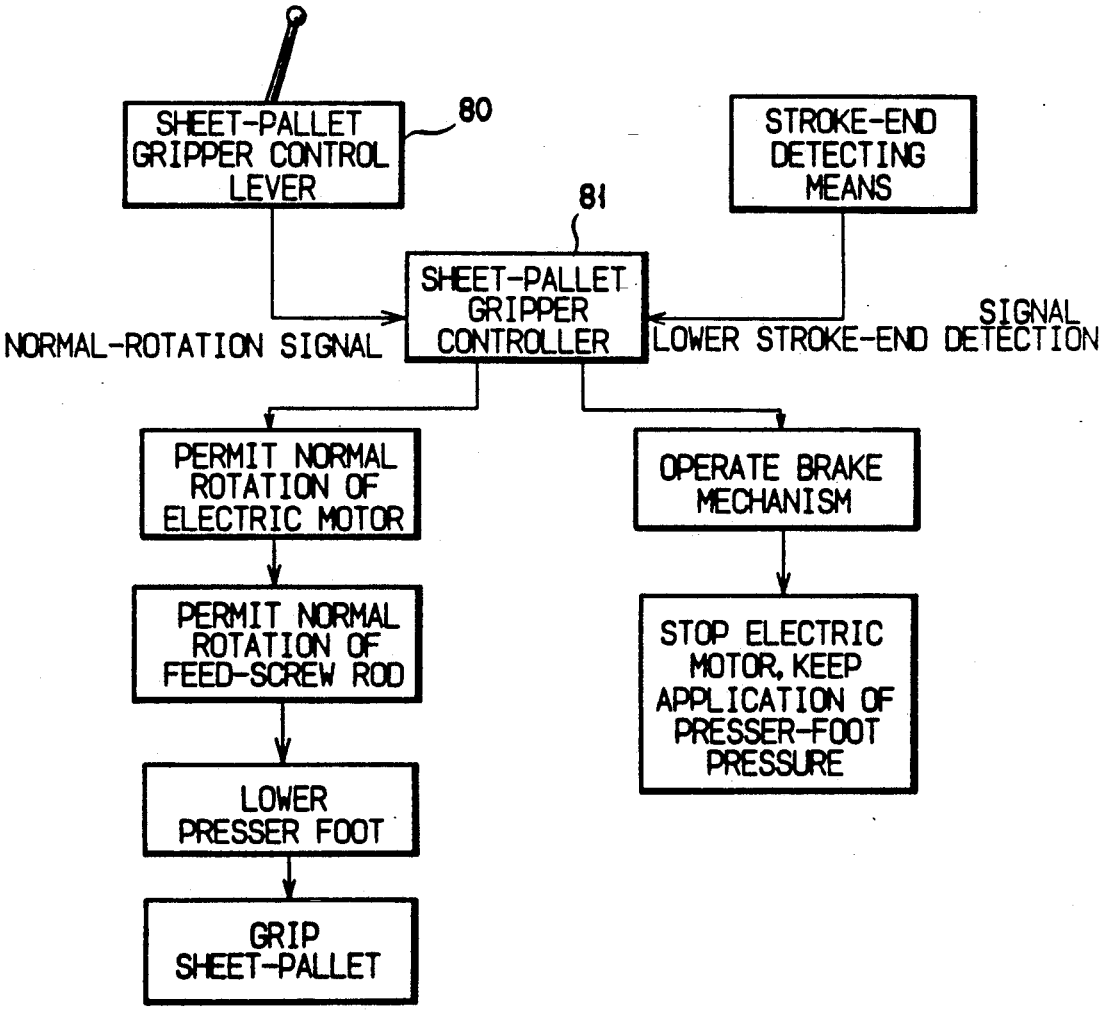
FIG. 15 is a flowchart showing all related processing steps of operation of the sheet-pallet gripper of the vehicle of the present invention.

In the sheet-pallet gripper 14 having the above construction shown in FIGS. 11 to 13, when the stroke-end detecting means detects the fact that the presser root 13 reaches the lower stroke-end position thereof, as shown in FIG. 15, the stroke-end detecting means issues a signal to the sheet-pallet gripper controller 81 so that the brake mechanism 94 is actuated to lock the electric motor 50 thereto, whereby the feed-screw rod 93 connected with the power output shaft of the motor 50 is also locked to the brake mechanism 94. As a result, the presser foot 13 or the sheet-pallet gripper 14 keeps on applying the predetermined gripping pressure to the sheet-pallet B' during the cargo loading operation of the vehicle. FIG. 15 is a flowchart showing all related processing steps of sheet-pallet gripping operation of the sheet-pallet gripper 14.

While the present invention has been described in connection with the above preferred embodiments thereof, it will be understood by those skilled in the art that many changes and modifications may be made without departing from the true spirit and scope of the present invention. Therefore, it is intended by the appended claims to cover all such changes and modifications which come within the true spirit and scope of the present invention.

What is claimed is:

1. In a cargo handling vehicle with forks having a push-pull unit for loading cargo onto or discharging said cargo from the forks of said vehicle, comprising:

a mast mounted on a front portion of a vehicle body of said vehicle;

a face member so mounted on said mast as to be movable along said mast up and down and movable along said forks of said vehicle back and forth; and a sheet-pallet gripper constructed of a sheet-pallet receiving piece and a presser foot means for gripping said sheet pallet so mounted on said face member as to be movable up and down relative to said sheet-pallet receiving piece which is fixedly mounted on a lower-end surface of said face member, the improvement comprising:

an electric motor for driving a link mechanism to perform a back and forth movement of said face member;

a power transmission means connected with said electric motor; and an electric-motor rotational speed control means for controlling a rotational speed of said electric motor according to an external force applied to a push-pull unit control lever for controlling said push-pull unit.

2. The cargo handling vehicle having said push-pull unit as set forth in claim 1, wherein:

said vehicle further comprises:

a face-member location detecting means for detecting a location of said face member in the back and forth movement thereof; and a controller for judging whether or not said sheet pallet carrying said cargo is loaded onto or discharged from said forks of said vehicle, by using a signal issued from said face-member location detecting means to issue a gripping signal to said sheet-pallet gripper to cause said gripper to grip said sheet pallet, and to issue a backward movement signal to said electric motor to move said face member backward to a position said cargo is judged to be loaded onto said forks of said vehicle and to issue a releasing signal to said sheet-pallet gripper to release said sheet pallet from said gripper, and to issue a forward movement signal to said electric motor to move said face member forward to a position said cargo is judged to be discharged from said forks of said vehicle.

3. The cargo handling vehicle having said push-pull unit as set forth in claim 2, wherein:

said vehicle further comprises a vehicle-body movement detecting means for detecting a traveling distance of said vehicle body;

said face-member location detecting means comprises a face-member traveling distance detecting means for detecting a traveling distance of said face member; and said controller comprises a current control means for controlling an amount of an electric current supplied to said electric motor on the basis of a difference between a traveling distance of said face member and that of said vehicle body.

4. The cargo handling vehicle having said push-pull unit as set forth in claim 1, wherein:

said vehicle further comprises:

an automatic control mechanism for automatically controlling the operations of loading and discharging said cargo;

a gear shifting means for shifting an operational condition of said vehicle to a forward movement condition, a neutral condition and a rearward movement condition;

a vehicle-speed control means for controlling a traveling speed of said vehicle;

a first sensor for issuing a signal when said gearshifting means is shifted to its neutral position corresponding to said neutral condition of said vehicle;

a second sensor for issuing a signal when said vehiclespeed control means is located in a second position; and a safety means for enabling said automatic control mechanism to operate at a time only when said first and said second sensor issue said signals.

5. The cargo handling vehicle having said push-pull unit as set forth in claim 1, wherein:

said presser foot means of said sheet-pallet gripper is constructed of: a presser root; a presser-foot driving electric motor for driving said presser foot up and down relative to said sheet-pallet receiving piece; a feed-screw rod connected to a lower end portion of a power output shaft of said presser-foot driving electric motor to extend downward; and a nut member which is threadably engaged with said feed-screw rod while connected with said presser foot through a guide member, said presser foot being disposed under said nut member.

6. The cargo handling vehicle having said push-pull unit as set forth in claim 5, wherein the vehicle further comprises:

a control lever for issuing a rotational-speed control signal to said presser-foot driving electric motor; and a sheet-pallet gripper controller for stopping operation of said presser-foot driving electric motor when an amount of an electric current or said presser-root driving electric motor reaches a predetermined value.

7. The cargo handling vehicle having said push-pull unit as set forth in claim 5, wherein said vehicle further comprises:

a presser-foot stroke end detecting means for detecting an upper and a lower stroke end position of said presser root.

* * * * *

UNITED STATES PATENT AND TRADEMARK OFFICE

CERTIFICATE OF CORRECTION

PATENT NO. : 5,297,916

DATED : March 29, 1994

INVENTOR(S) : Shinsuke Fujikawa, et al

It is certified that error appears in the above-indentified patent and that said Letters Patent is hereby corrected as shown below:

On the title page, Item [30] Foreign Application Priority Data,

Application No. 2 and 3 should read

May 2, 1989 [JP] Japan.....1-51645[U]
May 2, 1989 [JP] Japan.....1-51646[U]

Signed and Sealed this

Twenty-third Day of August, 1994

Bruce Lehman

*Attest:*

BRUCE LEHMAN

*Attesting Officer*

*Commissioner of Patents and Trademarks*